US007624988B2

(12) United States Patent
Shao

(10) Patent No.: US 7,624,988 B2
(45) Date of Patent: Dec. 1, 2009

(54) ELECTRIC DART GAME

(76) Inventor: Chia Mu Shao, Fuon Nan Nong Chang, Tonang District, Xia Men, Fujian Province (CN)

( * ) Notice: Subject to any disclaimer, the term of this patent is extended or adjusted under 35 U.S.C. 154(b) by 727 days.

(21) Appl. No.: 09/973,285

(22) Filed: Oct. 9, 2001

(65) Prior Publication Data

US 2002/0070501 A1 Jun. 13, 2002

(30) Foreign Application Priority Data

Dec. 11, 2000 (CN) ..... 00 2 67103

(51) Int. Cl.
*F41J 5/00* (2006.01)

(52) U.S. Cl. ..... 273/371; 273/348.3

(58) Field of Classification Search ..... 463/49–57; 273/371–377, 348, 403–404, 408
See application file for complete search history.

(56) References Cited

U.S. PATENT DOCUMENTS 3,836,148 A * 9/1974 Manning ..... 273/368
4,107,587 A * 8/1978 Ban et al. ..... 318/439
4,678,194 A * 7/1987 Bowyer et al. ..... 273/373
4,768,789 A * 9/1988 Clark ..... 273/371
5,209,491 A * 5/1993 Dodge ..... 273/371
6,089,571 A 7/2000 Cho
6,155,570 A * 12/2000 Allison et al. ..... 273/373
6,439,576 B1 * 8/2002 Montague ..... 273/371

FOREIGN PATENT DOCUMENTS

GB 2086243 * 5/1982
GB 2086243 A * 5/1982
WO WO 95/04251 * 2/1995

* cited by examiner

*Primary Examiner*—Dmitry Suhol
*Assistant Examiner*—Alex F. R. P. Rada, II
(74) *Attorney, Agent, or Firm*—Brinks Hofer Gilson & Lione

(57) ABSTRACT

An electronic dart game includes a dart and a dartboard provided with a frame and a main body for being shot by the dart. The dart game can be scored automatically for being provided a plurality of inductance coils on the frame and connected to a electronic scoring means. A point or a slender shaft of the dart is magnetized so that an electronic signal can be generated while the dart is shot to go through the inductance coils in accordance with the Lenz's law. Therefore, the chances for erroneous signal to occur are very slim. As the main body is designed directly to the frame, the dartboard has a stable one-piece surface, thus a player will have a similar satisfactory sensation as shooting onto a classical one-piece dartboard.

13 Claims, 6 Drawing Sheets

ELECTRIC DART GAME

FIELD OF THE PRESENT INVENTION

The present invention relates to an electronic dart game, particularly to a dart game with improved performance based on the principle of electromagnetic induction.

BACKGROUND OF THE INVENTION

Traditionally, a dart game is scored manually. In recent years, electronic dartboards have become popular as scoring can be done automatically by providing an electronic scoring means in those dart games. For example, U.S. Pat. No. 6,089,571 discloses an interesting electronic dart game, as shown in FIG. 1. In the material of prior art, the surface of a dartboard is divided into several independent scoring sections 42. Each scoring section 42 is loosely attached to the dartboard and electrodes of a switch provided respectively on conductor sheets 31 and 33 is under each scoring section 42. When a dart (not shown) hits a specific scoring section 42 on the dartboard, the impact causes the section 42 to push against the electronic switch underneath, thus, sending an electronic signal to an electronic scoring machine 10.

According to the disclosure of the prior art, referring to FIG. 2, the slide 70 and the block 80 may be moved inward of the frame 40 against the springs 74 when the block 80 is shot by a dart 88. Obviously, the structure of the prior art for arranging the conductor means is complex and it is not very easy to mount as its precision for locating switch on resilient sheets 31 and 33.

In addition, since the individual sections on the surface of the dartboard of the prior art are provided to be attached on the dartboard, the drawbacks of the prior art are also difficult to overcome. Referring to FIG. 3, the slides 70 each include one or more pins 71 for engaging into the block 80 and for securing the block 80 to the slide 70. Thus it is easy to understand that the attachment between blocks 80 and the dartboard are not secure and can cause other drawbacks. Firstly, when a dart hits a specific section on the dartboard, other sections on the dartboard may also vibrate and may trigger other membrane switches. Thus it not only causes confusion in scoring, but also the player can not have the same satisfactory sensation in comparison with an ordinary dart game. Secondly, removing a dart from any unstable section is not very easy.

SUMMARY OF THE INVENTION

An object of the present invention is to provide an electronic dart game having a plurality of inductance coils and a magnetic dart to be used for scoring.

Another object of the present invention is to provide a method of automatic scoring for a dart game based on the principle of electromagnetic induction.

To achieve the above purposes, there is provided an electronic dart game comprising a dart; a dartboard, provided with a frame, formed a plurality of scoring areas by a plurality of radial spiders and circumferential spiders which are arranged crossly and a main body for being shot by the dart, attached with the frame; and an electronic scoring means for displaying signals collected from the scoring areas, wherein the dart game comprises a plurality of inductance coils with predetermined turns, with the frame and connected to the electronic scoring means through cables; and the dart is provided with a magnetic substance.

In accordance with the present electronic dart game, a plurality of inductance coils are provided with predetermined shape to be engaged with the scoring areas.

In accordance with the present electronic dart game, a cross-section of each turn of the inductance coil matches and is smaller than that of the scoring areas.

In accordance with the present electronic dart game, the frame provided with the inductance coil is arranged in front of the main body.

In accordance with the electronic dart game, the frame provided with the inductance coil is arranged in back of the main body.

In accordance with the electronic dart game, the frame provided with the inductance coil is arranged in the main body.

In accordance with the electronic dart game, a plurality of the coils corresponding to different scoring areas representing the same score, are wired together before being connected to the electronic scoring means.

In accordance with the present electronic dart game, a point of the dart is provided with a magnetic substance.

In accordance with the present electronic dart game, a slender shaft of the dart is a magnetic substance.

In accordance with the present electronic dart game, the point and slender shaft of the dart are integrated and magnetized simultaneously.

In accordance with the present electronic dart game, the main body of the dartboard is made of bristle, natural fiber, synthetic fiber, plastic or the combination thereof.

A method of automatic scoring for an electronic dart game, comprises the steps of: dividing a dartboard into a plurality of areas by utilizing a frame and establishing a score for the each areas; attaching a main body for being shot by a dart to the frame; providing a plurality of inductance coils in predetermined shape engaged with the areas on the frame and connecting the coils to a scoring means of the dart game; magnetizing a point and slender shaft of the dart for changing distribution of magnetic field of the inductance coil at the moment of the main body of the dartboard being shot by the dart.

In accordance with the present method comprises the steps of providing a cross section of the each turn of the inductance coil to be smaller than that of the related areas; and wiring the coils representing the same score all together before being connected to a electronic scoring unit.

In one aspect of the present invention, the present dart game has a stable one-piece surface so that the player has a similar satisfactory sensation as shooting onto a classical one-piece dartboard.

In another aspect of the present invention, as a plurality of electromagnetic induction coils are firmly attached to the stable one-piece surface, the electronic scoring signal is generated only at the moment of the dart hitting the scoring areas on the dartboard, thus the chances for an erroneous signal is very slim.

In accordance with a further aspect of the present invention, the dart is easier to remove from the dartboard in comparison with the electronic dart game of the prior art.

BRIEF DESCRIPTION OF THE DRAWINGS

With reference to the following drawings, the preferred embodiments of the present invention shall be illustrated in detail.

DESCRIPTION OF THE PREFERRED EMBODIMENTS

The present electronic game includes a dartboard having a number of scoring areas for being shot at by a player and an electronic scoring means for displaying signals collected from the scoring areas.

Figure 1:
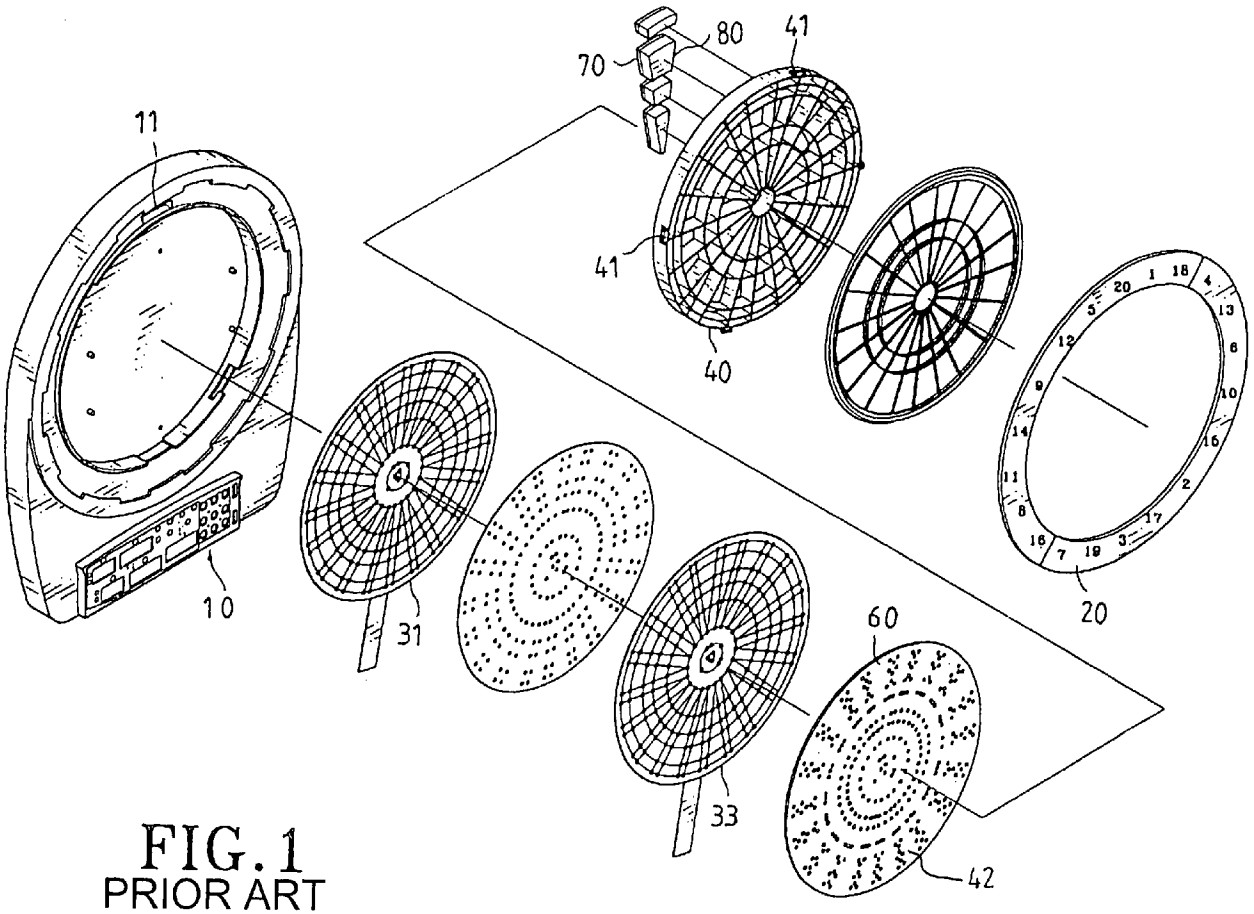
FIG. 1 PRIOR ART
FIG. 1 is an exploded view of an electronic dart game of the prior art.
Figure 2:
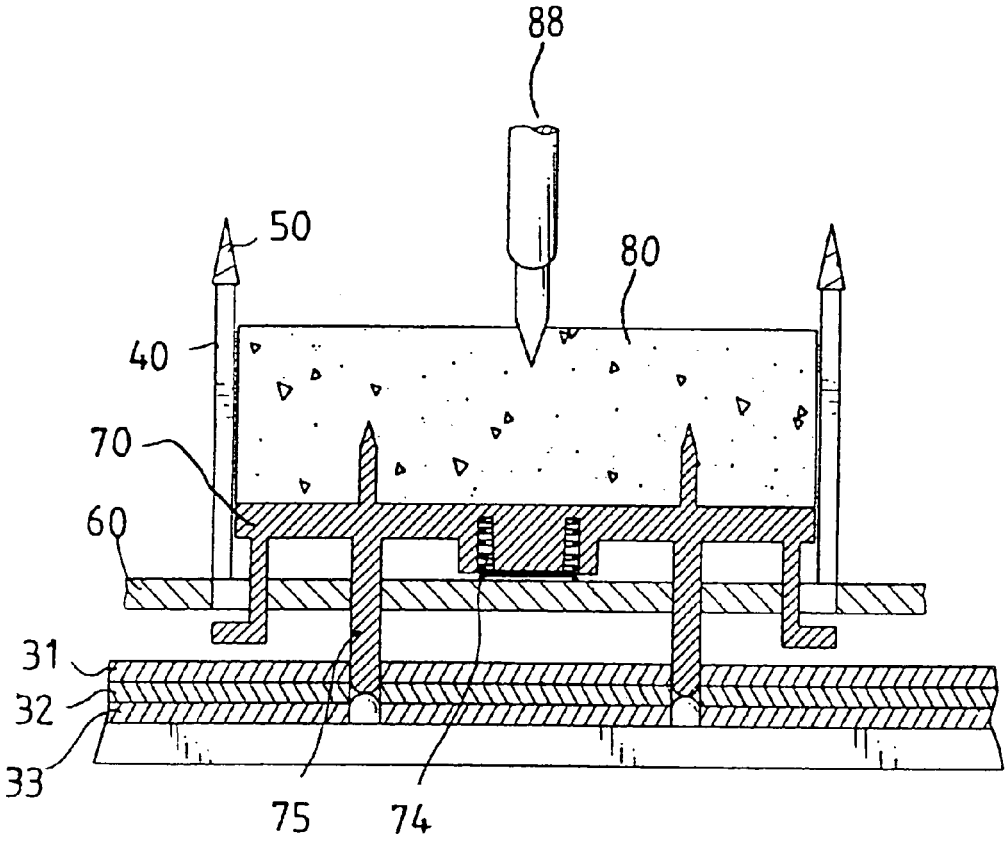
FIG.2 PRIOR ART
FIG. 2 is a cross sectional view of a prior art dartboard illustrating the operation of the switch used for conducting signals.
Figure 3:
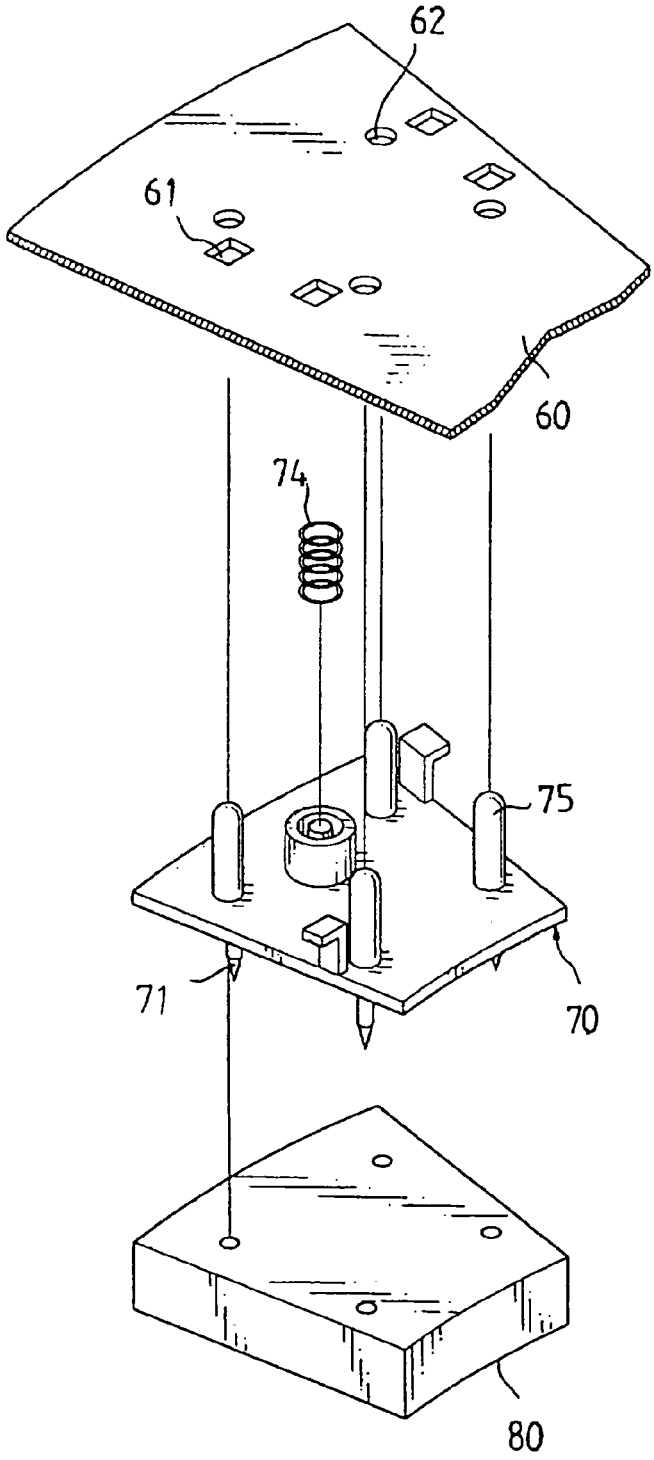
FIG.3 PRIOR ART
FIG. 3 is a partial exploded view of the prior art dartboard segment, in which the segment is shown up side down.
Figure 4:
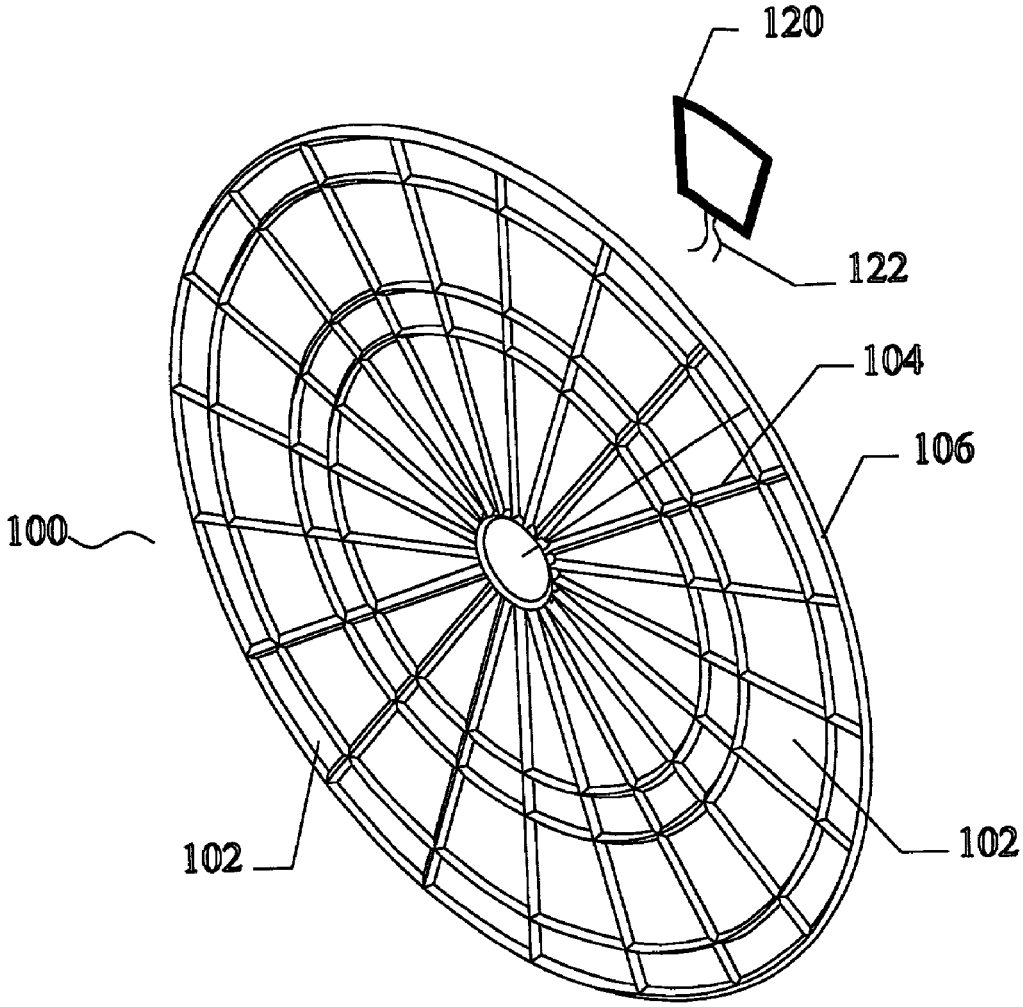
FIG. 4 is a perspective view of the dartboard of the present invention, showing a frame formed by a circumferential and radial spider.

Now referring to FIG. 4, the dartboard of the present invention includes a frame 100. A plurality of scored areas 102 is formed by a plurality of circumferential spiders 106 and radial spiders 104 which are arranged crossly each other. Each of the scoring areas 102 is respectively provided with an inductance coil 120. Each of coils 120 may be made up of several turns and each turn is needed to form a predetermined shape in order to match the scoring areas 102. As matter of fact, the cross-section of each turn of the inductance coil 120 is smaller than that of scoring areas 102 to ensure that the coil 120 is connected to a control unit of an electronic scoring means designed in the present dart game (not shown) through cables 122, which can display signals collected from the scoring areas 102.

Various scores are assigned to the scoring areas 102 in the dartboard. It is possible that some of areas 102 will be designated with the same score. Preferably, a plurality of coils 120 of the present invention correspond to different scoring areas 102 representing the same score, and are wired together before being connected to the electronic means (not shown).

Figure 5:
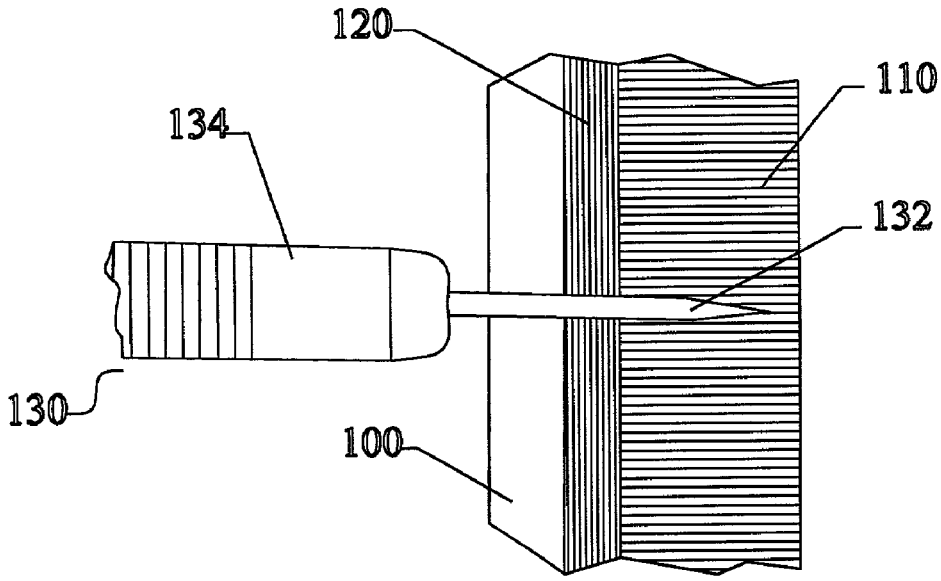
FIG. 5 is a partial schematic view of a preferred embodiment of the dartboard of the present invention, shown receiving a dart.
Figure 6:
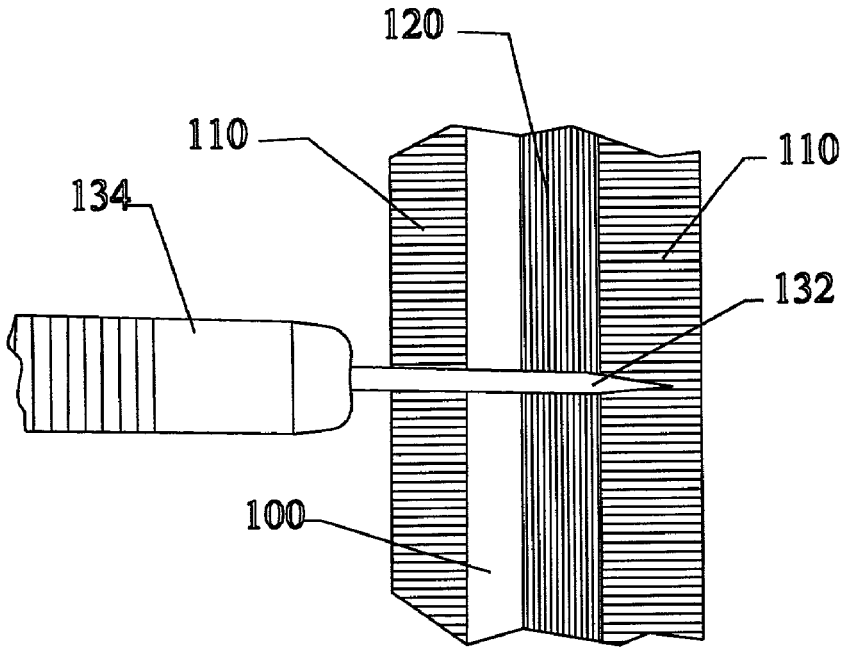
FIG. 6 is a partial schematic view of another embodiment of the dartboard of the present invention, shown receiving a dart.
Figure 7:
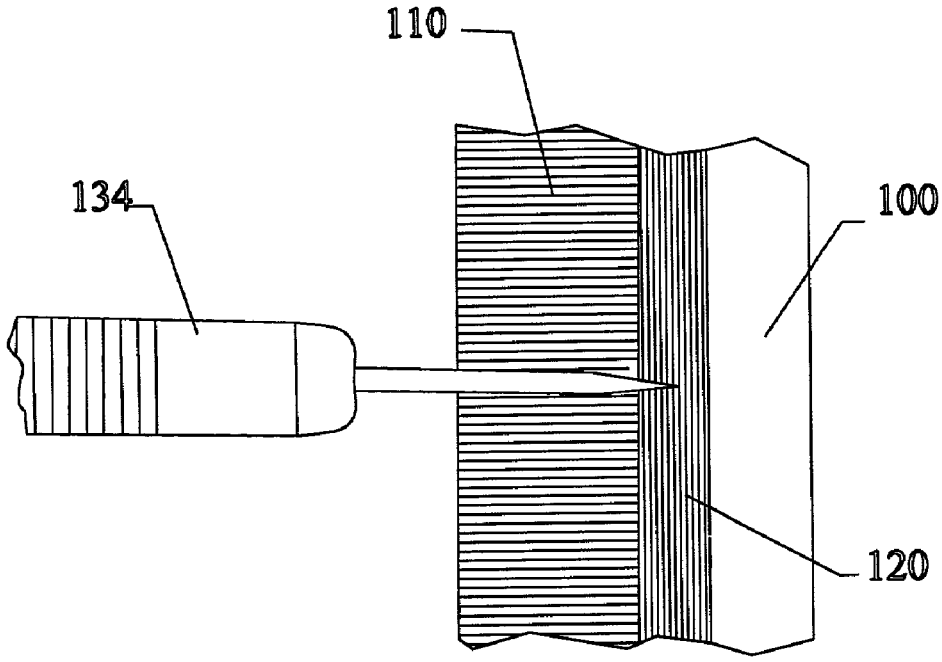
FIG. 7 is a partial schematic view of a further embodiment of the dartboard of the present invention, shown receiving a dart.

Referring to FIG. 5, the main body 110 of the dartboard is attached to the frame 100 and is used for being shot at by the dart 130. Therefore the main body 110 should be made of bristle, natural fiber, synthetic fiber, plastic or combinations thereof. In accordance with the present invention, the structure of the dartboard is substantially as simple as the traditional manual one and is easy to operate, as the inductance coils 120 can be directly provided on the frame 100 and main body 110 of the dartboard can be arranged in a flexible manner. In the first preferred embodiment, the frame 100 provided with the inductance coil 120 of the present invention is arranged in front of the main body 110. In the second embodiment, as shown in FIG. 6, the frame 100 provided with the inductance coil 120 is arranged within the main body 110. Obviously, the frame 100 provided with inductance coils 120 can be arranged in back of the main body 110, as shown in FIG. 7.

Figure 8:
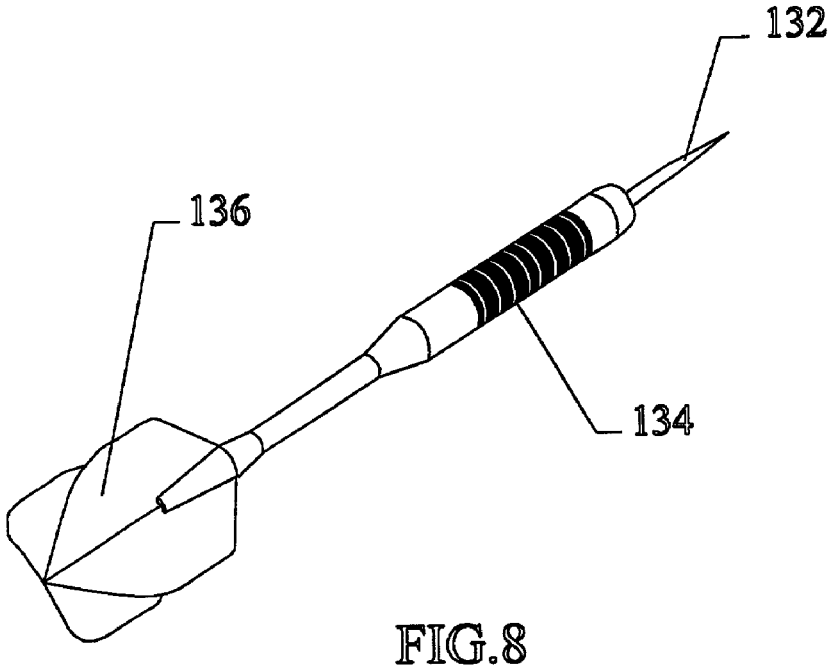
FIG. 8 is a perspective view of the dart of the present invention.

To achieve the object of the present invention, another essential part of the present invention is the dart 130, as shown in FIG. 8. The dart 130 usually comprises a point 132; a slender shaft 134 and a tail fin 136. Particularly, the dart 130 of the present invention is provided with a magnetic substance. That is, a slender shaft 134 and the point 132 can be magnetized respectively or be integrated and magnetized simultaneously.

When the dart 130 with a magnetic point 132 is shot onto the main body 110 of the dartboard, the instantaneous displacement of the magnetic point 132 through the coil 120 induces a current or voltage signal on the coil 120 in accordance with Lenz's law; the signal can be amplified in a signal processor (not shown). Then the amplified electronic signal will be transmitted to an electronic scoping means (not shown) to engage in calculation and display. Once the dart 130 is stuck on the dartboard, there is no more induction current.

Because the instantaneous electronic signal is induced only at the moment the magnetic point 132 of the dart 130 is moving through the coil 120, confusion in electronic scoring can be avoided.

It is necessary to point out that the magnetic part of the dart 130 need not go through the coil 120 completely; an electronic signal can be inducted even when the dart 130 closing with the coil 120, as magnetic lines of force around the dart 130 has already cut the coil 120, as shown in FIG. 5.

Furthermore, the electronic signal of the present invention intended to be calculated and displayed is generated by magnetic lines of force of the dart 130 cutting the coil 120 when the dart 130 is shot to go through the object areas. The intensity of the electronic signal will depend on the elements, such as the density of magnetic lines of force, turns of coil and rapidity for cutting magnetic lines of force etc. In other words, the generated signal dimension is in direct proportion with these elements. Therefore, the manner for enhancing the dart to increase the density of magnetic lines of force or increasing turns of coil or increasing rapidity of dart can be applied if the control unit of the present dart game requires a rather large signal. Actually, it is better that the present invention need not provide much more turns in coil, and thus costs for the present invention can be reduced accordingly, as the rapidity of the dart will be large enough to generate an available signal to be easily collected. In another aspects, an electronic signal cannot be generated when the rapidity of the dart through the coil is lack, so the chances for erroneous signals to occur are very slim, such as when a player removes the dart from the dartboard. In other aspects, the signal of the present invention will be generated at the moment the dart hits the dartboard and will disappear off the coil after the dart hitting the dartboard as the rapidity at the moment is zero. Therefore, the method of scoring at each time for the present invention is unique, even when the same object area is shot many times without removing the darts from the area, the signals can be collected accurately and the signal can be transmitted only from the coil surrounded the dart even though the point shot by the dart is adjacent to other scoring areas. Therefore, the method of the present invention for scoring is accurate and applicable.

The above description should not be construed as limiting the scope of this invention but as merely proving the illustration of some of the presently preferred embodiments of the invention. For example, the dartboard in the present invention and an electronic scoring means may be combined into one entity.

What is claimed is:

1. An electronic dart game comprising:

a dart;

a dartboard, provided with a frame, formed of a plurality of scoring areas by a plurality of radial spiders and circumferential spider which are arranged crossly;

a main body receiving said dart, attached to said frame; and an electronic scoring means for displaying signals collected from said scoring areas;

a plurality of coreless inductance coils with predetermined turns, provided with said frame and connected to said electronic scoring means through cables;

said dart is provided with a magnetic substance;

each of said coreless inductance coils is associated with a corresponding one of said scoring areas and defines a scoring signal zone; and a scoring signal is generated by said dart entering said scoring signal zone, said signal is transmitted to said electronic scoring means.

2. An electronic dart game according to claim 1, wherein said plurality of coreless inductance coils are provided with predetermined shape to be engaged with said scoring areas.

3. All electronic dart game according to claim 2, wherein cross-section of each turn of said coreless inductance coil matches and is smaller than that of said scoring areas.

4. An electronic dart game according to claim 3, wherein said frame provided with said coreless inductance coils is arranged in front of said main body.

5. An electronic dart game according to claim 3, wherein said frame provided with said coreless inductance coils is arranged in back of said main body.

6. An electronic dart game according to claim 3, wherein said frame provided with said coreless inductance coil is arranged in said main body.

7. An electronic dart game according to claim 3, wherein a plurality of said coreless coils correspond to different scoring areas representing the same score, are wired together before being connected to said electronic scoring means.

8. An electronic dart game according to claim 1, wherein a point of said dart is provided with a magnetic substance.

9. An electronic dart game according to claim 8, wherein a slender shaft of said dart is provided with a magnetic substance.

10. At electronic dart game according to claim 9, wherein said point and slender shaft of said dart are integrated and magnetized simultaneously.

11. An electronic dart game according to claim 1, wherein said main body of said dartboard is made of bristle, natural fiber, synthetic fiber, plastic or combinations thereof.

12. An electronic dart game comprising:

a dart;

a dartboard, provided with a frame, formed of a plurality of scoring areas by a plurality of radial spiders and circumferential spider which are arranged crossly;

a main body for receiving said dart, attached to said frame; and an electronic scoring means for displaying signals collected from said scoring areas;

a plurality of coreless inductance coils with predetermined turns, provided with said frame and connected to said electronic scoring means through cables;

said dart is provided with a magnetic substance;

each of said coreless inductance coils is associated with a corresponding one of said scoring means and defines a scoring signal zone; and a scoring signal is generated by said dart moving through one of said coreless inductance coils, and said signal is transmitted to said electronic scoring means.

13. An electronic dart game comprising:

a dart;

a dartboard, provided with a frame, formed of a plurality of scoring areas by a plurality of radial spiders and circumferential spiders which are arranged crossly;

a main body for receiving said dart, attached to said frame; and an electronic scoring means for displaying signals collected from said scoring areas;

a plurality of coreless inductance coils with predetermined turns, provided with said frame and connected to said electronic scoring means through cables;

said dart is provided with a magnetic substance;

each of said cureless inductance coils is associated with a corresponding one of said scoring means and defines a scoring signal zone; and an electronic field is generated only when said dart moves through said coreless inductance coils, and signal is transmitted to said electronic scoring means.

* * * * *